United States Patent [19]

Biagiotti

[11] Patent Number: 5,040,738

[45] Date of Patent: Aug. 20, 1991

[54] REWINDING MACHINE FOR THE FORMATION OF LOGS OF WOUND PAPER WHICH CAN BE CUT TO FORM USABLE SMALL ROLLS

[75] Inventor: Guglielmo Biagiotti, Capannori, Italy

[73] Assignee: Perini Navi S.p.A., Lucca, Italy

[21] Appl. No.: 497,924

[22] Filed: Mar. 23, 1990

[30] Foreign Application Priority Data

Mar. 30, 1989 [IT] Italy ..... 9385 A/89

[51] Int. Cl.[5] ..... B65H 18/20; B65H 19/28

[52] U.S. Cl. ..... 242/66

[58] Field of Search ..... 242/66, 74, 56 A, 56 R; 156/458, 578, 356, 357

[56] References Cited

U.S. PATENT DOCUMENTS

| | | | |
|---|---|---|---|
| 2,827,873 | 3/1958 | Thorn | 156/356 X |
| 3,162,393 | 12/1964 | Gelleke | 242/66 |
| 3,727,854 | 4/1973 | Grotzbach | 242/66 |
| 3,841,578 | 10/1974 | Dorfel | 242/66 |
| 4,003,782 | 1/1977 | Farrelly | 156/578 X |
| 4,111,737 | 9/1978 | Wesley | 156/458 |
| 4,327,877 | 5/1982 | Perini | 242/66 |
| 4,736,703 | 4/1988 | Mattei et al. | 156/356 |
| 4,962,897 | 10/1990 | Bradley | 242/66 X |

*Primary Examiner*—John M. Jillions

*Attorney, Agent, or Firm*—Francis J. Bouda

[57] ABSTRACT

The machine for rewinding webs of paper from a large roll onto a core to form small rolls includes a continuous conveyor for the cores, a distributor associated with said conveyor for applying adhesive to the cores, an upper winding cylinder, a lower winding cylinder defining a nip with the upper cylinder for receiving a core, and an insertion group which advaces up the core from said conveyor into said nip. The lower cylinder is smooth. The adhesive distributor includes a dispensing cylinder having a cylindrical surface abe to apply the adhesive substantially in the form of an axially-extending longitudinal strip onto the surface of the cores.

7 Claims, 3 Drawing Sheets

Fig. 4
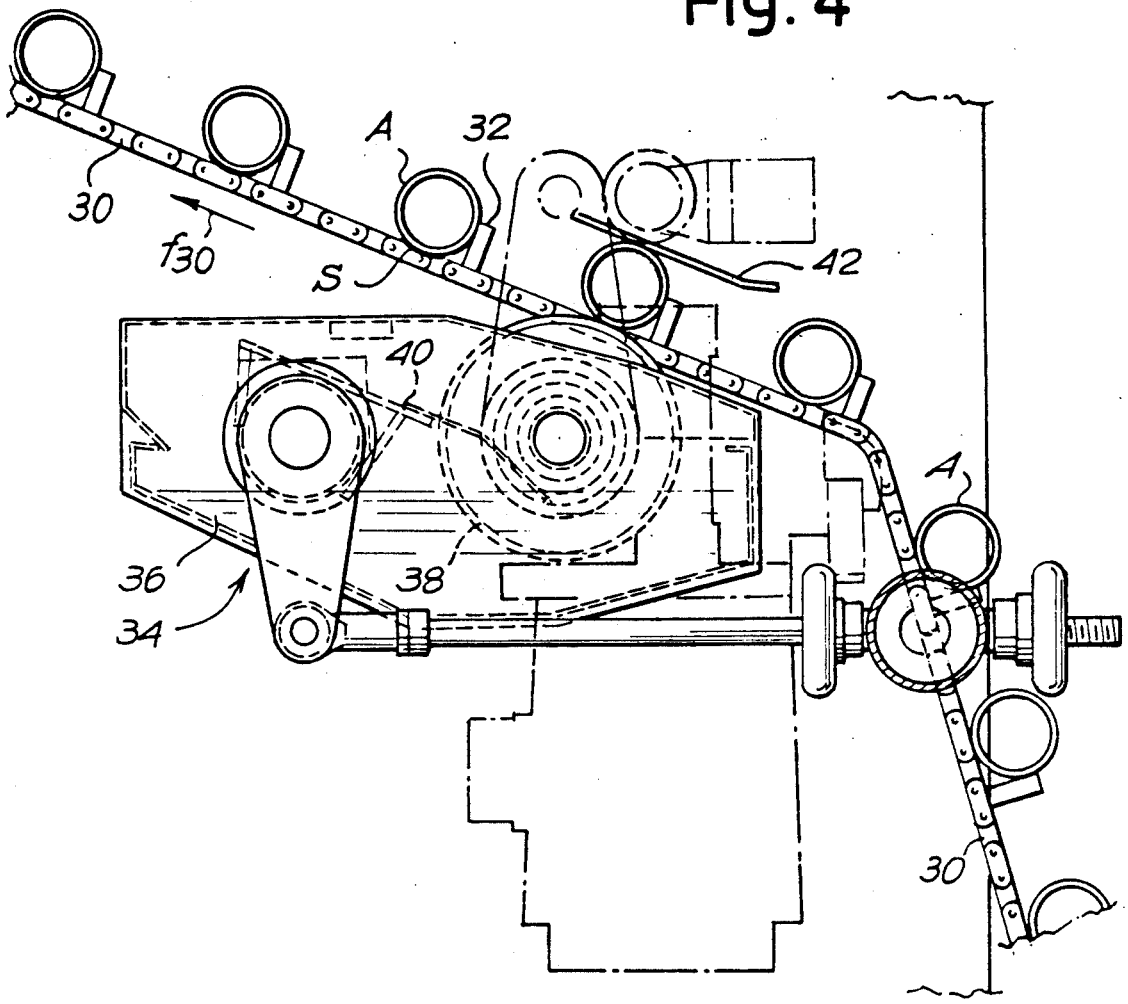
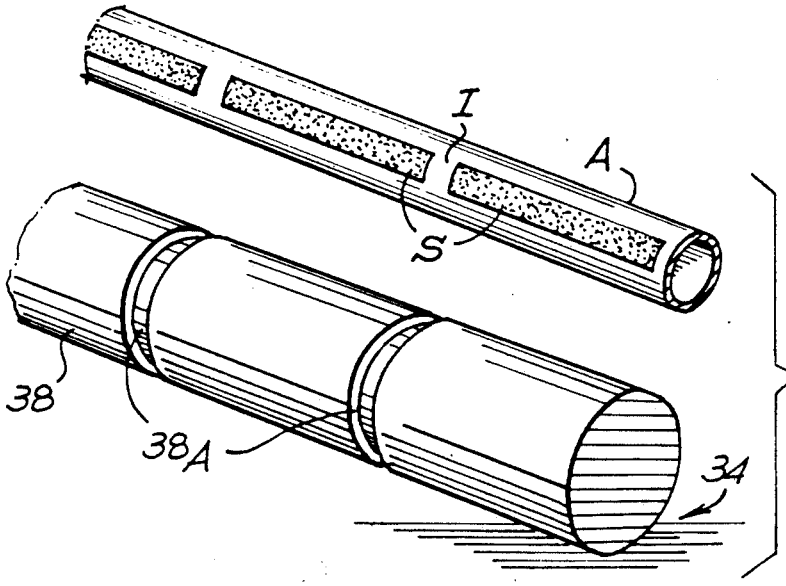
Fig. 5

REWINDING MACHINE FOR THE FORMATION OF LOGS OF WOUND PAPER WHICH CAN BE CUT TO FORM USABLE SMALL ROLLS

DESCRIPTION

The invention has the purpose of providing a rewinding machine for the paper converting which is simplified and improved, as will be apparent from a reading of the following description.

The rewinding machine in question is intended for the formation, from a large supply roll of "logs", i.e., rolls of paper or other on mostly tubular cores, for the production of small rolls of toilet paper, kitchen towels or the like, and includes a continuous core conveyor, a distributor associated with said conveyor for applying adhesive to the cores, an upper winding cylinder, a lower winding cylinder defining a nip with the upper cylinder for the insertion of a core, and an insertion group which advances the core from said conveyor into said nip. According to the invention, said lower cylinder is smooth. Moreover, the adhesive distributor includes a dispensing cylinder with cylindrical surface able to apply the adhesive substantially in the form of a longitudinal strip onto the surface of the cores.

The surface of said adhesive dispensing cylinder may be provided with spaced apart annular grooves, in order to provide limited interruptions of said longitudinal strip of adhesive onto the core. The pusher of said insertion group acts in alignment with said interruptions.

The continuous conveyor for the cores is driven to a zone close to the nip between the two winding cylinders, and the cores are placed on support brackets from which they are inserted into said nip by means of the insertion group.

The machine may also comprise means for controlling the width of the adhesive strip on the core.

The invention will be better understood by the following description and the attached drawing, which shows a practical, non-limiting example of the same invention. In the drawing:

FIG. 4 shows the adhesive application section of FIG. 1.

FIG. 5 shows the adhesive dispensing cylinder and a core with a strip of adhesive applied by said cylinder, both in partial perspective view.

Figure 1:
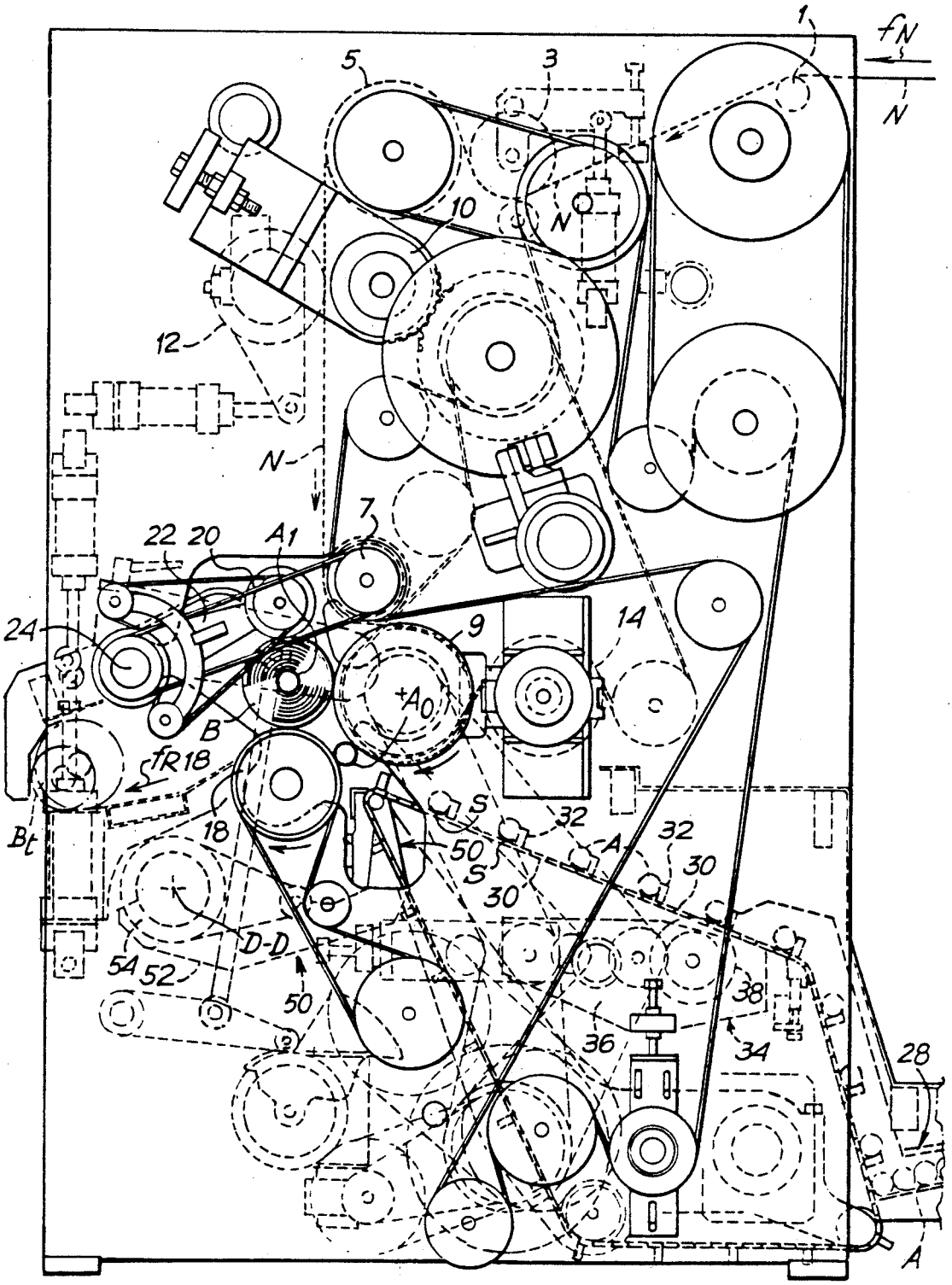
FIG. 1 shows an overall and schematic side view of the machine.
Figure 2:
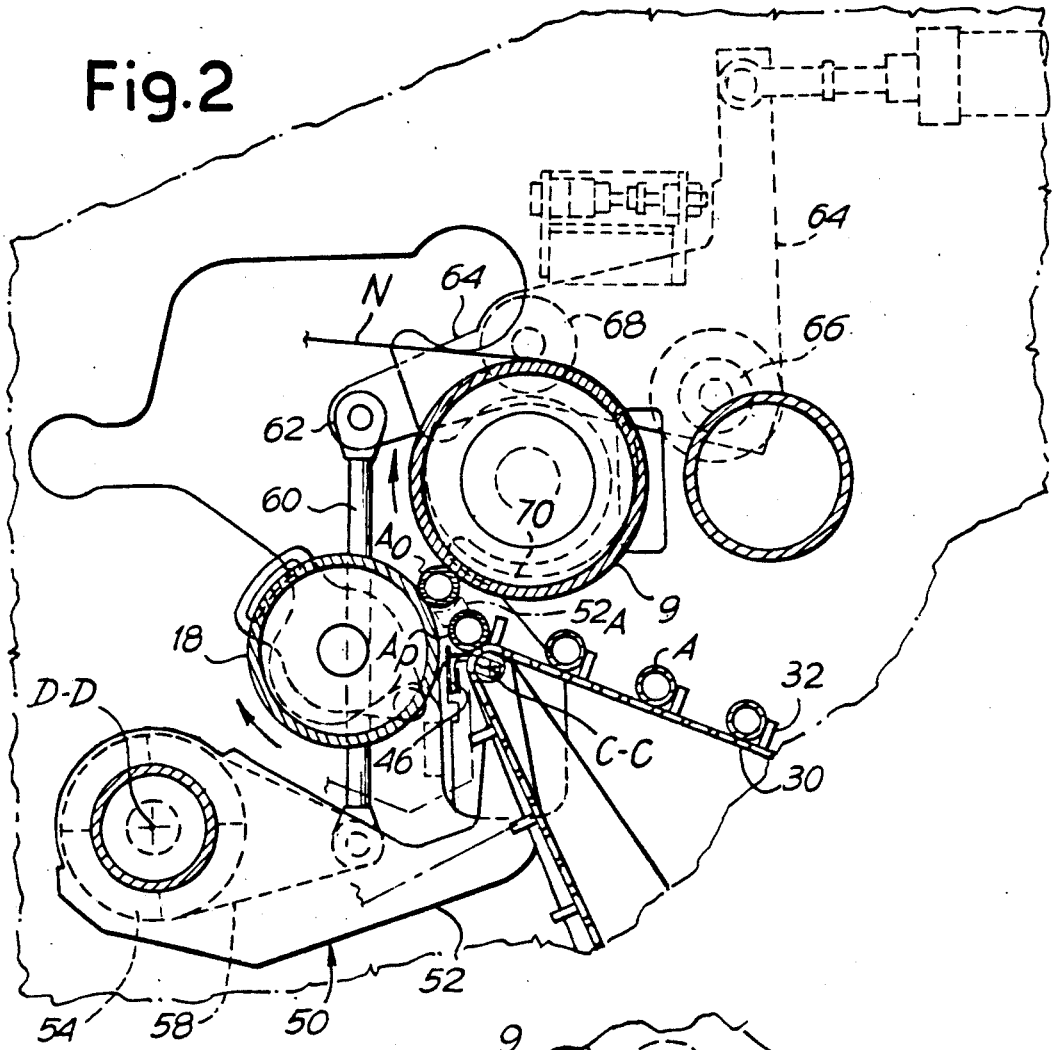
FIG. 2 shows a detail of FIG. 1.

Referring now to FIG. 1, N indicates the web of paper or the like which is fed continuously from a large roll (not shown), directed and driven by driving rollers like those indicated by 1, 3, 5, and 7 to the upper cylinder 9. Numerals 10 and 12 indicate a pair of rollers between which the web N is made to pass and transversally perforated to form connected sheets of paper ready for re-winding into a small roll or log.

Numeral 14 generally indicates a cylinder for separating the web by cutting upon completion of a roll or log. This cutting cylinder 14 may be omitted in some cases when, for the separation of the tail of the web being wound into a roll or log from the leading edge of the web which will form a new roll or log, a snap separation by excessive tensile stress on the web takes place when a perforation is between the wound log and a new core.

Numeral 18 indicates a lower winding cylinder which is adjacent the upper winding cylinder 9 and defines therewith a nip for the insertion of a tubular core indicated by Ao, to start the winding. Numeral 20 indicates a third cylinder or roller intended to cooperate with cylinders 9 and 18 for the formation of a log B of paper web wound over a core indicated by A. This third cylinder 20 is carried by arms 22 pivoted at 24 on the machine frame. The axis of cylinder 9 is in fixed position, while the axis of cylinder 18 may be adjusted. This general arrangement is known in the art and disclosed in patents of the present application.

The core A inserted in position Ao receives the web carried by the cylinder 9. This core is made to rotate between cylinders 9 and 18, and the log formed therein comes into contact with the cylinder 20 as its diameter gradually increases, owing to the winding of the web N on the core. The log B gradually moves from position Ao to position Al as the process of formation is completed. The log then rolls in the direction of arrow fR to the dwell position Bt to be moved away therefrom afterwards.

The cores A are fed from a supply 28 to a continuous conveyor 30 consisting of a series of chains having seats 32 for carrying the cores A one at a time from the supply 28. The conveyor 30 moves in the direction of arrow f30 with intermittent movement, so as to carry each core, taken from supply 28, close to the nip between cylinders 9 and 18, from which it can be inserted in the nip formed between the two cylinders 9 and 18.

In the path between the supply 28 and the position close to the pair of cylinders 9 and 18 for the insertion, the cores pass an adhesive dispensing device generally indicated by 34. As shown in FIG. 4, this adhesive distributor 34 comprises a basin 36 which holds the fluid adhesive, and a rotating dispensing cylinder 38 whose cylindrical surface is substantially continuous, interrupted only by spaced grooves for the purpose to be indicated below.

The adhesive distributor 34 is to constructed as to apply adhesive in a longitudinal relatively narrow strip-like zone on the outer surface of each core A which, when it is carried by the conveyor 30, lightly touches the dispensing cylinder 38 which dampens the above-mentioned longitudinal strip. If the dispensing cylinder 38 is provided with a series of annular grooves 38A, the strip S of adhesive on the core is interrupted at the zones (I) where there is no contact with the dispensing cylinder 38.

The adhesive distributor 34 includes a striker or scraper 40, suitably contacting the cylindrical surface of the rotating dispensing cylinder 38, and also may include a counteracting element 42 for pressing the cores as they pass in contact with the dispensing cylinder 38. Accordingly, by moving past the adhesive distribution station 34, each core A is wetted with a strip of adhesive S on the underside of the core A. It is then conveyed between distributor 34 and the zone of winding cylinders 9 and 18. This strip S may be continuous or interrupted at short sections in alignment with the grooves 38A which are placed at least in alignment with the chains of the continuous conveyor.

Near the two winding cylinders 9 and 18, the continuous conveyor 30 is driven around a very small turning roll C—C. In this zone, a shelf defined by brackets 46 is provided which receives the incoming cores, one at a time, at position Ao for the insertion thereof in the nip between the cylinders 9 and 18. The core at position Ap is kept stationary during a short stop of conveyor 30 to be picked up from the position Ap (on the brackets 46) by an insertion device generally indicated by 50, which includes an oscillating unit having a plurality of arms 52 which pivot about the axis D—D.

Figure 3:
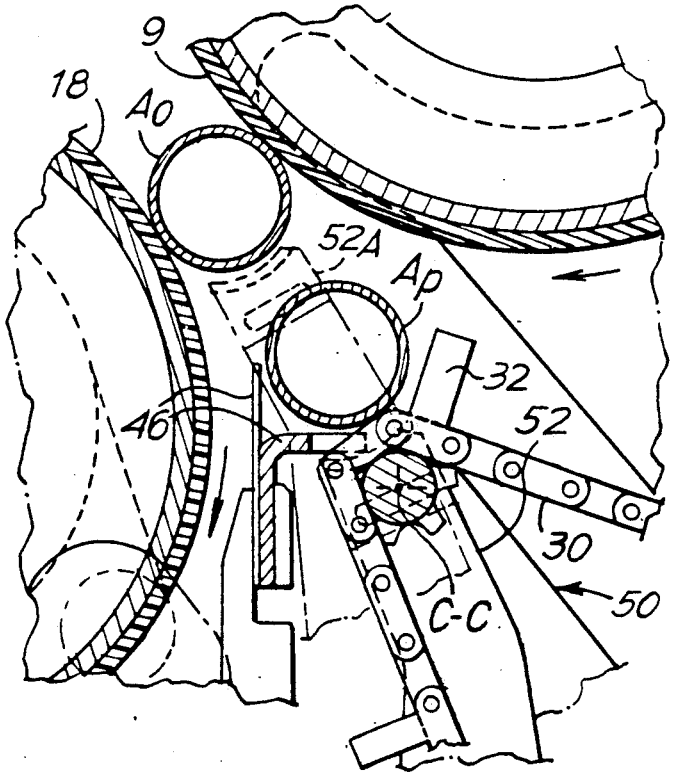
FIG. 3 shows an enlarged detail of FIG. 2.

The oscillation of the unit, including the arms 52 and the member 54 of the insertion device 50, is of a very limited distance, as these arms 52, with their ends 52A, must only move the core from position Ap to position Ao within the nip between cylinders 9 and 18 as shown in FIG. 3. This small angular reciprocating displacement of arms 52 of the oscillating unit is achieved by a device described in the Italian Patent Application No. 9475 A/87 filed Jan. 9, 1987 by the same applicant. This comprises a crank solid with member 54 and thus oscillating about the axis D—D. This crank portion of member 54 is pivoted on the axis D—D. This crank is driven by a tension rod 60, diagrammatically indicated in the drawing, which is in turn connected at 62 to arm 64. The arm 64 is pivoted at 66 on the machine frame and comprises a tappet which cooperates with a cam 70, which may be a part of the upper winding cylinder 9.

It is thus possible to achieve the timely actuation of the oscillating unit of the insertion group 50 when a core is to be inserted from position Ap to position Ao for the removal of the completed log B. The cam 70 may be replaced by a cam carried or operated by perforator 10, so as to make the introduction of the cores corresponding to any given length of web between lines of perforations.

The ends 52A of arms 52 and/or the brackets 46 may be disposed in alignment with the interruptions of the strip S of adhesive applied longitudinally on the cores, so as to prevent these ends 52A, and possibly the brackets 46, from being smeared with adhesive. If the interruptions of strip S of adhesive are not provided, i.e., if no provision is made for the grooves 38A in the adhesive-dispensing cylinder 38 of distributor 34, the operation is still satisfactory, as these ends 52A remain in contact with the core when it is inserted in the position Ao between the two winding cylinders 9 and 18, and thus also during the beginning of rotation of core Ao for the paper winding, such rotation being caused by the cylinders 9 and 18. As a consequence, when the core begins to rotate, it wipes any residual adhesive from the ends 52A and reduces the amount of adhesive on said ends to a minimum.

The machine so far described is particularly simple, and the product obtained therewith is more satisfactory than that obtained by the known systems. Among the several advantages, the following ones may be pointed out:

The adhesive distributor 34 is simple, particularly as far as the construction of the dispensing cylinder 38 is concerned, since the latter is a smooth roller with no crests like those of prior art. On the contrary, the dispensing cylinder 38 has a substantially cylindrical surface with only a few spaced-apart grooves 38A which can be easily machined in the cylinder.

The presence of a counter-roller cooperating with dispensing cylinder 38 of the adhesive distributor is optional as a direct application is possible during the transfer of the cores by conveyor 30 in such a way that they lightly touch the adhesive dispensing cylinder 38.

The insertion group 50 is particularly simple, because the stroke to be run by arms 52 is very short (since only a displacement of the core from position Ap to position Ao is required). Moreover, there occurs only a single stroke instead of a double stroke as currently provided in the known rewinding machines. In particular, the connection between the connecting rod 58 and the pivot 62 is provided by a simple tension rod, while in the rewinding machines of known construction, the tension rod is extendible and retractable by means of a cylinder-piston system.

Means may be used ensuring the control of the width of adhesive strip applied on the core. For example, it is possible to have a more or less sliding action between the member 42 and the core, or it is possible to have a movable counteracting member supplied with steady motions, or it is possible to vary the transit rate of the cores in the zone of adhesive applications, or it is possible to vary the rotary speed of the dispensing cylinders, or it is possible to alter the relative speeds of the various working members. Provision may also be made for having the surface of the adhesive dispensing cylinder 38 embossed on its surface so as to provide a suitable friction with the core.

The handling of the cores for the transfer thereof from conveyor 30 to the nip between the winding cylinders 9 and 18 is far more simple and safer and, in particular, is such as to avoid spontaneous rotation of the core and errors in the orientation of the adhesive strip on the arrival at position Ao.

It should be noted that the lower winding cylinder 18 has a uniformally smooth surface, i.e., with no grooves. Therefore, the roll or log B, which is formed on this cylinder 18, is not deformed with ridges of the relatively soft surface of the wound paper. Such ridges were created in winders of the prior art when the logs of this toilet tissue were wound up on lower cylinder rolls having grooves in them.

Besides the lack of such impressions, i.e., annular ridges on the formed log, there is obtained a better grip of the leading edge of the paper to be wound over the core at position Ao, due to the distribution of a longitudinal, substantially continuous strip S of adhesive on the core, instead of an annular distribution at relatively narrow zones provided in the previous systems. This allows a greater reliability and productivity to be reached owing to a sure grip of the paper onto the core at position Ao and to an efficient drag by the lower winding cylinder 18.

Other advantages will be easily apparent to those skilled in the art.

It is understood that the drawing shows an example given only as a practical demonstration of the invention, as this may vary in the forms and dispositions without departing from the scope of the idea on which the same invention is based.

Having thus described my invention, what I claim as new and desire to protect by Letters Patent are the following:

1. A rewinding machine for the production of small rolls of toilet paper, kitchen towels and the like, from a large supply of rolls, said machine including:

a core supply including a quantity of cores, and [a continuous conveyor for the cores]

a distributor with adhesive for applying adhesive to the cores, an upper winding cylinder, a lower winding cylinder, a nip between the upper cylinder and the lower cylinder for receiving a core, a continuous conveyor for the cores which extends from said distributor to a zone close to the nip between the two winding cylinders, an insertion device which picks up the core from said conveyor and inserts it into said nip, and said lower cylinder having no grooves.

2. The rewinding machine of claim 1 wherein the adhesive distributor includes a dispensing cylinder developed with a cylindrical surface to apply the adhesive substantially in the form of an axially-extending longitudinal strip onto the surface of the cores.

3. A rewinding machine of claim 2 wherein the surface of the adhesive dispensing cylinder is provided with spaced-apart narrow annular grooves which form short interruptions in said longitudinal strip of adhesive on the cores.

4. The rewinding machine of claim 3 including a pusher in said insertion device for moving said cores, said pusher arranged in alignment with the spaced-apart grooves, said pusher picking up each core and inserting it into said nip.

5. The rewinding machine of claim 2 wherein the adhesive applicator includes means for controlling the width of strip of adhesive on the core.

6. The rewinding machine of claim 1 including a support adjacent said nip for receiving a core from said conveyor and holding it until removed therefrom by said insertion device.

7. The rewinding machine of claim 1 including a third movable winding roller.

* * * * *